US008836608B2

(12) United States Patent
Dandekar et al.

(10) Patent No.: US 8,836,608 B2
(45) Date of Patent: Sep. 16, 2014

(54) MIMO ANTENNA ARRAYS BUILT ON METAMATERIAL SUBSTRATES

(75) Inventors: Kapil R. Dandekar, Philadelphia, PA (US); Prathaban Mookiah, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 654 days.

(21) Appl. No.: 13/131,891

(22) PCT Filed: Dec. 1, 2009

(86) PCT No.: PCT/US2009/066280

§ 371 (c)(1), (2), (4) Date: Jun. 23, 2011

(87) PCT Pub. No.: WO2010/065555

PCT Pub. Date: Jun. 10, 2010

(65) Prior Publication Data

US 2011/0260946 A1 Oct. 27, 2011

Related U.S. Application Data

(60) Provisional application No. 61/118,860, filed on Dec. 1, 2008.

(51) Int. Cl.
*H01Q 1/48* (2006.01)

(52) U.S. Cl.
USPC ..... 343/893; 343/787

(58) Field of Classification Search
USPC ..... 343/893, 787
See application file for complete search history.

(56) References Cited

U.S. PATENT DOCUMENTS 5,434,581 A 7/1995 Raguenet et al.
2008/0048917 A1 2/2008 Achour et al.

OTHER PUBLICATIONS

Buell et al., "A Substrate for Small Patch Antennas Providing Tunable Miniaturization Factors", IEEE Transactions on Microwave Theory and Techniques, Jan. 2006, 54(1), 135-146.

PCT Application No. PCT/US2009/066280 : International Search Report and Written Opinion of the International Searching Authority, Feb. 1, 2010, 8 pages.

Piazza et al., "Computational Electromagnetic Analysis of a Reconfigurable Multiport Circular Patch Antenna for Mimo Communications", EMTS 2007 International URSI Commission B—Electromagnetic Theory Symposium, Jul. 26-28, 2007, 3 pages.

*Primary Examiner* — Karl D Frech
(74) *Attorney, Agent, or Firm* — Baker & Hostetler LLP

(57) ABSTRACT

A magnetic permeability enhanced metamaterial is used to enhance the antenna array of a Multiple Input Multiple Output (MIMO) communication system. A rectangular patch antenna array is formed including a stack of a plurality of unit cells, where each unit cell includes an inductive loop of magnetic permeability enhanced metamaterials embedded in a host dielectric substrate. The use of such metamaterials permits the antenna arrays to be made smaller, and have less mutual coupling, when using a metamaterial substrate. The measured channel capacities of the antenna arrays are similar for the metamaterial and conventional substrates; however, the capacity improvement when using MIMO relative to single antenna communication systems is greater for antennas on metamaterial substrates.

2 Claims, 9 Drawing Sheets

MIMO ANTENNA ARRAYS BUILT ON METAMATERIAL SUBSTRATES

CROSS-REFERENCE TO RELATED APPLICATIONS

This application is the National Stage of International Application No. PCT/US2009/066280 filed Dec. 1, 2009, which claims the benefit of U.S. Application No. 61/118,860, filed Dec. 1, 2008, the disclosures of which are incorporated herein by reference in their entireties.

STATEMENT OF FEDERALLY SPONSORED RESEARCH

Portions of the disclosure herein may have been supported in part by grants from the National Science Foundation, Grant Nos. CNS-0322795 and ECS-0524200. The United States Government has certain rights in the invention.

TECHNICAL FIELD

The present invention relates generally to the field of MIMO antenna systems. Specifically, the present invention relates to MIMO antenna arrays built on metamaterial substrates.

BACKGROUND

Wireless communication systems have become pervasive and ubiquitous to the point where data rate and quality of service requirements have become comparable to those of wired communication systems. Next generation wireless systems incorporate multiple-input multiple-output (MIMO) techniques to achieve their performance goals. MIMO systems promise higher channel capacities compared to single antenna systems by exploiting the spatial characteristics of the multipath wireless propagation channel. The theoretical performance gain achievable by MIMO systems is limited due to a number of practical design factors, including the design of the antenna array and the amount of inter-array element mutual coupling. While mutual coupling can be alleviated by increasing the spacing between array elements, accommodating multiple antennas with large spacing in modern consumer devices may be impossible due to stringent space constraints. In order to meet such demanding, and often contradictory, design criteria, antenna designers have been constantly driven to seek better materials on which to build antenna systems.

As disclosed in U.S. Pat. No. 6,933,812, metamaterials are a broad class of synthetic materials that could be engineered to wield permittivity and permeability characteristics to system requirements. It has been theorized that by embedding specific structures (usually periodic structures) in some host media (usually a dielectric substrate), the resulting material can be tailored to exhibit desirable characteristics. These materials have drawn a lot of interest recently due to their promise to miniaturize antennas by a significant factor while operating at acceptable efficiencies.

SUMMARY

The invention relates to a method of improving the capacity and mutual coupling performance of MIMO antenna arrays and an apparatus that implements such a method.

In an exemplary embodiment, the method includes the steps of:

selecting $N_T$ transmitter antennas and $N_R$ receiver antennas each comprising a metamaterial substrate so as to form a resonance structure based on induced inductance of the metamaterial substrates combined with the capacitance of the metamaterial substrates;

determining a statistical description of the transmission environment including the MIMO antenna array, where the statistical description is provided in a matrix $H_i$, where $H_i$ is the normalized channel matrix corresponding to the $i^{th}$ channel realization where $H_i$ includes interference and signal to noise as a product of the location and spacing of the $N_T$ transmitter antennas and $N_R$ receiver antennas;

using the normalized channel matrix to compute the channel capacity C for each array configuration for a given subcarrier; and placing the $N_T$ transmitter antennas and the $N_R$ receiver antennas, mounted on the metamaterial substrates, in an array configuration so that the resulting antenna array has channel capacities C that are approximately the same as channel capacities C of relatively larger antenna arrays formed without the metamaterial substrates.

In an exemplary embodiment, the channel capacity C of each channel i is computed as:

$$C = \frac{1}{N_{ch}} \sum_{i=1}^{N_{ch}} \log_2\left[\det\left(I_{N_R} + \frac{SNR}{N_T} H_i H_i^{\dagger}\right)\right]$$

where $N_{ch}$ is the number of channel realizations measured at each receiver antenna position for every subcarrier, $I_{NR}$ is the $N_R \times N_R$ identity matrix, SNR is signal to noise ratio in channel i, and $H_i^{\dagger}$ is a complex conjugate transpose operation.

The invention also relates to a rectangular patch antenna array including antennas mounted on a substrate comprising a plurality of unit cells having rectangular inductive spiral loops embedded uniformly and uni-directionally within a host dielectric substrate so as to form a magnetic permeability enhanced metamaterial. The unit cells are uniformly stacked on each other to form a three-dimensional resonance structure that is oriented orthogonally to a magnetic field of the antennas. The dimensions of the rectangular inductive spiral loops are selected whereby the metamaterial has a resonance frequency that matches a resonance frequency of the antennas. The rectangular inductive spiral loops of each unit cell have the same dimensions and same resonance frequency. The dimensions of the rectangular inductive spiral loops of the unit cells are tuned whereby the resonance frequency of the metamaterial matches the resonance frequency of the antenna. The apparatus may also include a recessed microstrip feed line on the substrate. In an exemplary embodiment, each unit cell is spaced from each other unit cell by a spacing of $\lambda/2$ or $\lambda/20$ in an azimuthal plane of the substrate, where $\lambda = c/f$, where c is the speed of light and f is the resonance frequency of the substrate. The antenna array may be incorporated into a wireless transmission apparatus such as a wireless local area network (LAN), a personal wireless communications device, or another device in which a portable antenna is desirable.

DETAILED DESCRIPTION OF ILLUSTRATIVE EMBODIMENTS

A detailed description of illustrative embodiments of the present invention will now be described with reference to FIGS. 1-11. Although this description provides a detailed example of possible implementations of the present invention, it should be noted that these details are intended to be exemplary and in no way delimit the scope of the invention.

Inside a dielectric material, the free space wavelength of an antenna is scaled down by a factor of $\sqrt{\mu_r \in_r}$, where $\in_r$ is the dielectric constant and $\mu_r$ is the relative magnetic permeability of the material. Thus, the size of an antenna can be significantly reduced by choosing a high $\in_r$ or high $\mu_r$ material. Though miniaturization can be achieved using high $\in_r$ materials, it comes at the cost of increased dielectric losses that can significantly affect antenna efficiency. However, materials that exhibit a high $\mu_r$ in the microwave region do not exist in nature and designers have been compelled to use lossy high $\in_r$ materials when antenna miniaturization is a key design requirement. Fortunately, materials that exhibit high $\mu_r$, or magnetic permeability enhanced metamaterials, can now be artificially engineered to lead to smaller antennas without compromising other design criteria.

Magnetic permeability enhanced metamaterials are constructed by stacking up unit cells that can store magnetic energy by virtue of their structure. A unit cell for the material used in embodiments of the invention contains an inductive spiral loop embedded in a host dielectric material. Magnetic energy storage is created in the unit cell when a magnetic field passes normal to the plane of the spiral, inducing a current in the loop. This phenomenon effectively creates an inductance within the host substrate material. The material is formed by stacking up these unit cells uniformly in three dimensions. A resonance behavior is generated at frequencies dictated by the inductance of the loop and capacitances that exist between adjacent arms in the loop. Thus at resonance, a significant net magnetic energy storage is induced within the 3D structure and thus the magnetic permeability of the otherwise non-magnetic substrate material is enhanced. In order to realize a miniaturized antenna, it is therefore necessary to match the resonance frequency of the material and the antenna. The resonance frequency of this structure can be controlled by tuning the spiral and substrate dimensions.

Figure 1:
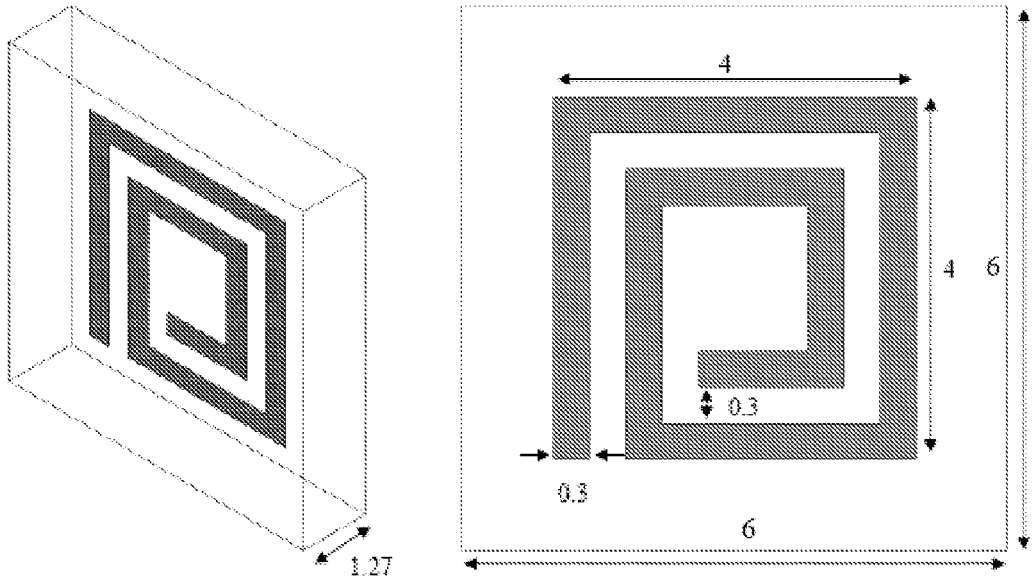
FIG. 1 illustrates the structure of a metamaterial unit cell containing a spiral loop embedded in a dielectric substrate (all units are in mm).

The unit cell structure designed to resonate in the 2.48 GHz band is shown in FIG. 1 along with its dimensions. FR4 ($c_r$=4.4, $\mu_r$=1, loss tangent tan $\delta$=0.02) was chosen as the host material for the metamaterial substrate. Initial simulations of the unit cell and the stacked 3D structure were carried out using the finite element method software HFSS. Bulk material properties of this substrate were extracted from the simulated S parameters. The effective $\mu_r$ was found to be approximately 4.2 in the direction perpendicular to the plane of the unit cell. This substrate also experiences an enhancement in permittivity due its geometry. The extracted effective $c_r$ was 9.7. A calculation for the antenna resonant length using these effective values for $c_r$ and $\mu_r$ is also in agreement with the designed antenna length. The resulting electric and magnetic tan $\delta$ are 0.2 and 0.05. These values imply a lossy substrate leading to poor antenna efficiencies.

Figure 2:
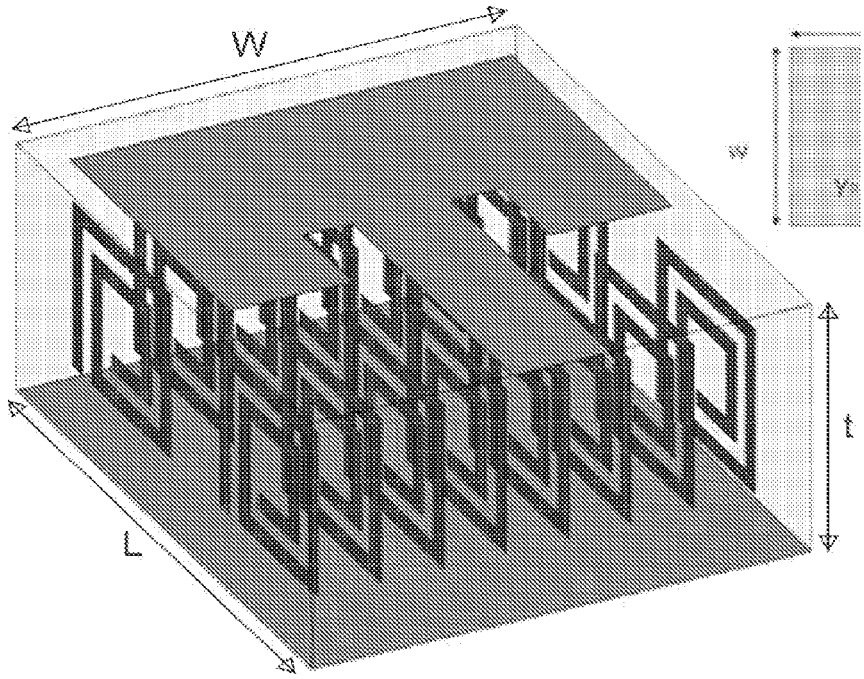
FIG. 2 illustrates a rectangular patch antenna array built on a magnetic permeability enhanced metamaterial substrate.
Figure 3:
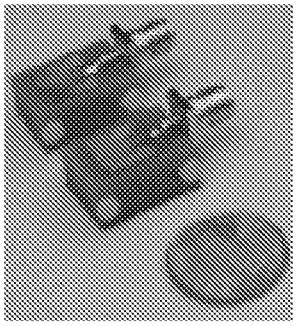
FIG. 3 illustrates a fabricated metamaterial antenna structure in accordance with the invention.

The antenna geometry embodying exemplary embodiments of the invention is a rectangular patch antenna with a recessed microstrip feed line, backed by a ground plane and operating in the $TM_{010}$ mode built on the magnetic permeability enhanced metamaterial substrate. TM refers to the transverse mode of the electromagnetic radiation. FR4 was chosen as the host material in the magnetic permeability enhanced substrate as well as the conventional substrate used for comparison. The unit cell structure is shown in FIG. 1. The substrate formed by stacking the unit cells and the antenna array is shown in FIG. 2. The unit cells are stacked together uniformly in three dimension to form a 3D resonance structure. The resulting arrangement would have the rectangular spiral loops embedded uniformly and uni-directionally within the structure as shown in FIG. 3, which shows a fabricated and measured antenna. The relevant substrate and antenna dimensions are shown in Table I.

TABLE I

Substrate and Antenna Dimensions

| Dimension (mm) | Metamaterial | FR4 |
|---|---|---|
| L | 18 | 45 |
| W | 10 | 40 |
| l | 9 | 33 |
| w | 9 | 29 |
| $V_0$ | 3 | 6 |
| $W_0$ | 2 | 5 |
| 1 | 8 | 1.27 |

Current is induced in the spiral loop only by magnetic fields oriented in a direction perpendicular to the plane of the spiral. Hence, magnetic permeability enhancement is unidirectional in the substrate. Since the magnetic field in the near field of a rectangular patch antenna would be in a direction perpendicular to its radiating edge, this antenna design can fully utilize the permeability available in this direction. The substrate and the antenna were designed to resonate at 2.48 GHz. Initial antenna simulations were carried out in the finite difference time domain using HFSS. The effective $\mu_r$ derived theoretically for this structure as in is approximately 3.7 in the direction perpendicular to the plane of the unit cell.

As shown in FIG. 2, the rectangular patch antenna array of the invention includes antennas mounted on a substrate comprising a plurality of unit cells having rectangular inductive spiral loops embedded uniformly and uni-directionally within a host dielectric substrate to form a magnetic permeability enhanced metamaterial. The unit cells are uniformly stacked on each other to form a three-dimensional resonance structure that is oriented orthogonally to a magnetic field of the antennas. Dimensions of the rectangular inductive spiral loops are selected whereby the metamaterial has a resonance frequency that matches a resonance frequency of the antennas. The dimensions of the rectangular inductive spiral loops of the unit cells may be tuned whereby the resonance frequency of the metamaterial matches the resonance frequency of the antenna. Each unit cell is spaced from each other unit cell by a spacing of $\lambda/2$ or $\lambda/20$ in an azimuthal plane of the substrate, where $\lambda=c/f$, where c is the speed of light and f is the resonance frequency of the substrate. The rectangular inductive spiral loops of each unit cell have the same dimensions and same resonance frequency. The antenna array also contains a recessed microstrip feed line on the substrate. Examples of applications for such an antenna include use in wireless local area networks and personal wireless communications devices.

The designed metamaterial antenna achieved a miniaturization factor of approximately 3 in the radiation edge length compared to a rectangular patch antenna operating at the same frequency built on a conventional FR4 substrate. Also a significant 90% reduction in the area occupied by the antenna plane is achieved. However, due to the higher thickness of the metamaterial substrate, the entire volume for a single antenna on a metamaterial substrate was approximately 37% less than that of a conventional antenna substrate.

Figure 4:
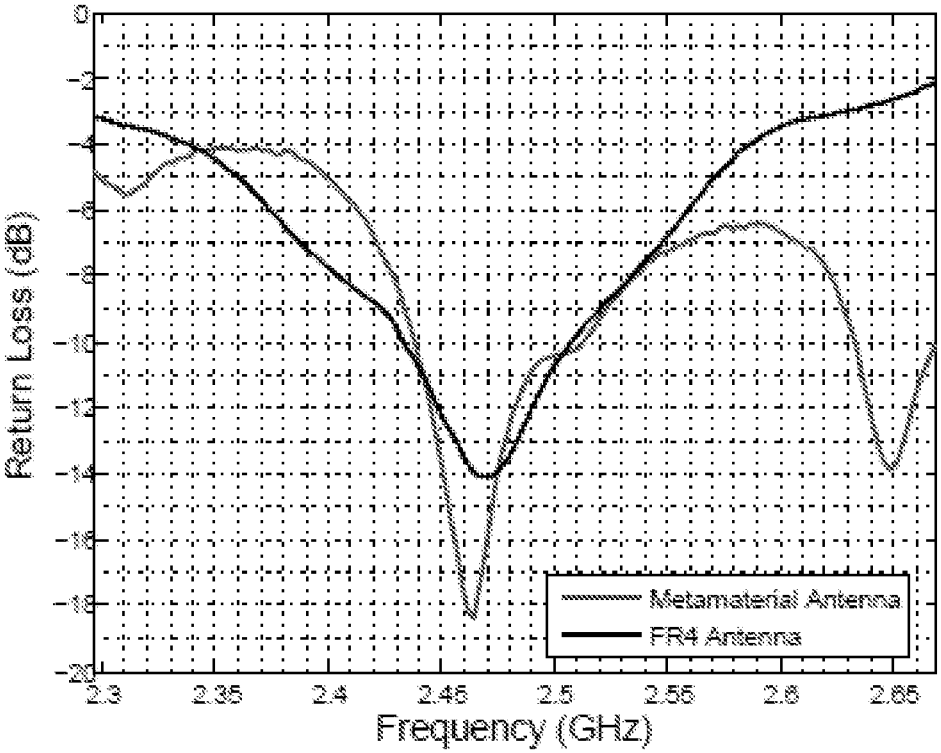
FIG. 4 illustrates a return loss characteristic for the metamaterial and FR4 substrate antennas of the invention.

FIG. 4 shows the return loss characteristics of the designed antenna. The −10 dB bandwidth of this antenna was approximately 50 MHz. This bandwidth was comparable to that of an antenna built on a conventional FR4 substrate.

Figure 5:
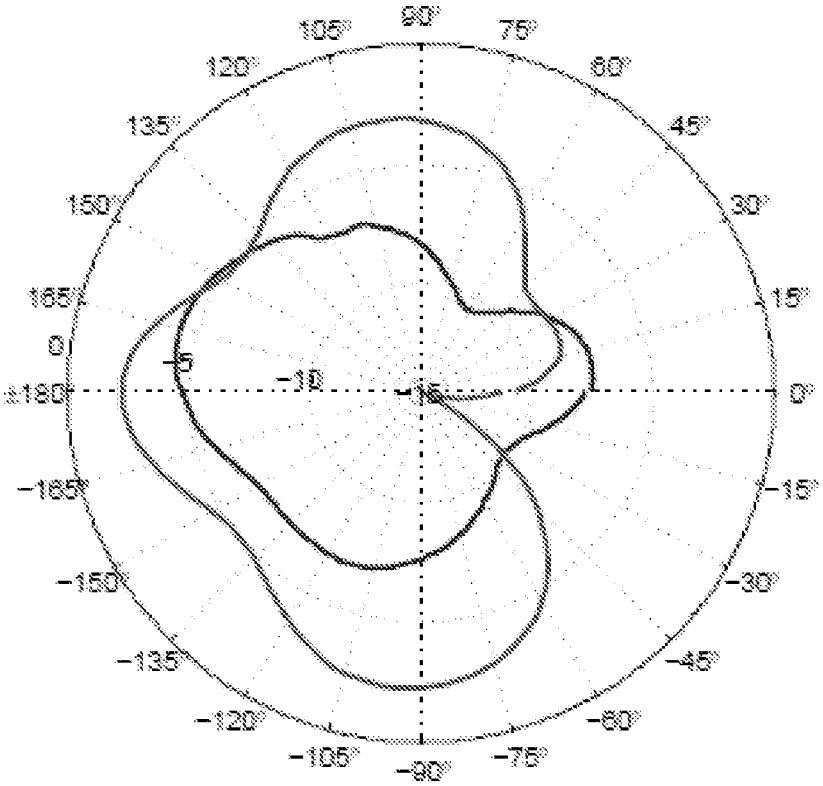
FIG. 5 illustrates measured gain in the azimuth plane ($\theta=90°$) for metamaterial and FR4 antennas where the spacing between the antenna elements is 60 mm ($\lambda/2$).
Figure 6:
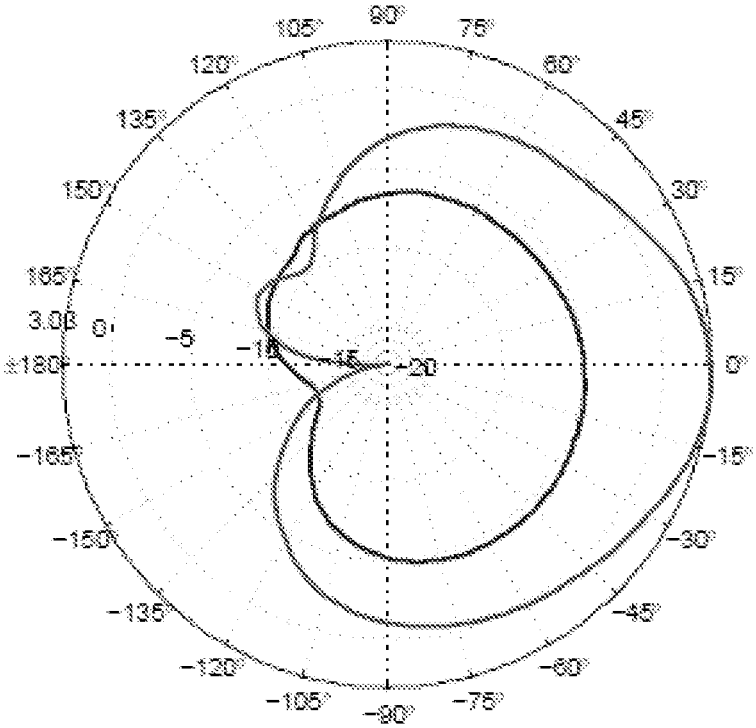
FIG. 6 illustrates measured gain in the E plane ($\theta=0°$) for the metamaterial and FR4 antennas where the spacing between the antenna elements is 60 mm ($\lambda/2$).

FIG. 5 shows the measured gain of the metamaterial and FR4 antennas for an inter-element spacing of 60 mm $\lambda/2$ in the azimuth plane. The corresponding pattern in the E plane is shown in FIG. 6. The conventional FR4 substrate antenna has 7 dB more gain than the metamaterial substrate antenna in the E plane and approximately 3 dB more gain in the azimuth plane. These gain differences can be attributed to two factors. First, the metamaterial substrate antenna has a much smaller ground plane compared to the conventional FR4 substrate antenna which leads to more fringing effects and a reduction in directivity. However, the primary reason for the gain differences is the smaller efficiency of the metamaterial substrate antenna. The current induced in the inductive loop in each unit cell contributes to ohmic losses. Additionally, the capacitive losses in the host medium are also increased due to the increased thickness of the stacked substrate structure. Further refinement of the design is desired in order to improve the efficiency of this antenna structure and thus improve the overall gain. Although the difference in gain is significant in the E plane, the primary contribution to the difference in performance between the two antennas would be due to the gain difference in the azimuth plane. The azimuth plane gain difference has a more significant effect on capacity performance since multipath signal propagation in indoor environments (such as the one used for channel measurements below) happens mostly in this plane.

Figure 7:
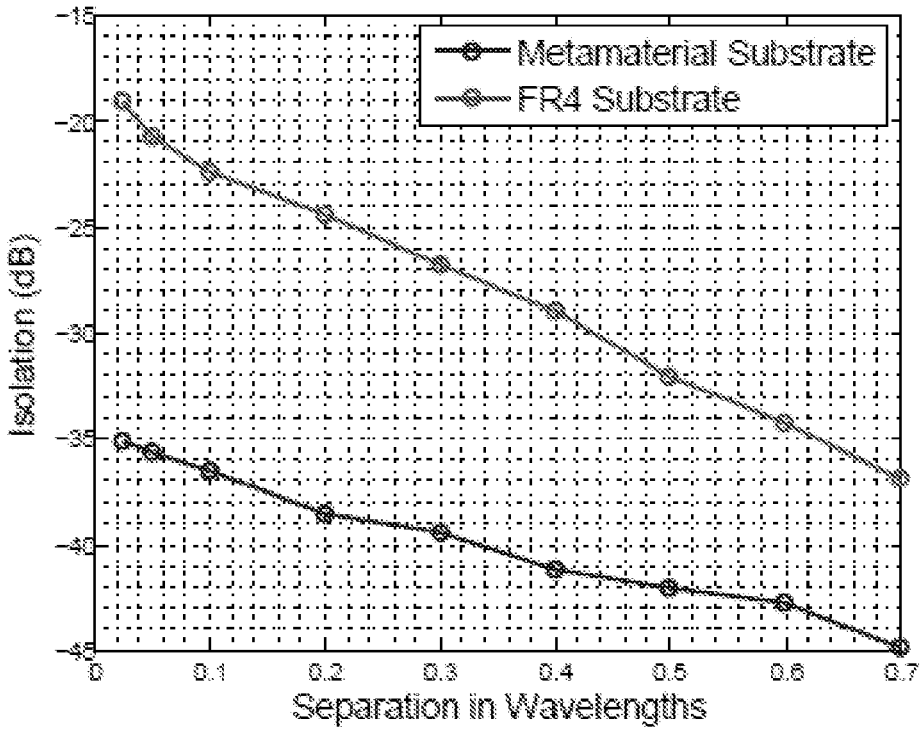
FIG. 7 illustrates measured mutual coupling between the antenna elements for different antenna spacing for the metamaterial and FR4 antenna arrays of the invention.

Mutual coupling is an important factor that affects the operation of a MIMO system. For arrays on both substrates considered herein, the mutual coupling between array elements was analyzed in terms of the isolation (S21) between them. The measured isolations for the metamaterial antenna array and the conventional FR4 antenna array are shown in FIG. 7. The result shows a difference of 15 dB in isolation between the metamaterial and FR4 antenna arrays at very low inter element spacing. This difference drops to around 10 dB for higher spacing. This trend implies that the received signals will be significantly less correlated for the metamaterial antenna compared to the FR4 antenna for a given spacing. Another interesting observation is that the isolation does not vary as much with inter-element spacing for the metamaterial antenna; the difference in isolation between 3 mm ($0.05\lambda$) and 84 mm spaced antennas ($0.7\lambda$) is 10 dB whereas the isolation varies by 16 dB for the FR4 antennas.

Cross-polarization discrimination (XPD) quantifies the degree of the sense of polarization of a linearly polarized antenna. The XPD of an antenna is given by:

$$XPD = \frac{\int_0^{2\pi}\int_{-\pi/2}^{2\pi/2} G_\theta(\theta,\varphi)\cos\theta d\theta d\varphi}{\int_0^{2\pi}\int_{-\pi/2}^{2\pi/2} G_\varphi(\theta,\varphi)\cos\theta d\theta d\varphi}$$

where $G_\theta(\theta,\phi)$ and $G_\phi(\theta,\phi)$ are the $\theta$ and $\phi$ components of the antenna gain pattern.

The antennas are linearly polarized as expected of a rectangular microstrip patch antenna and XPD decreases with inter-element spacing for both antenna types. Less polarization distortion occurs due to the presence of the other antenna elements in the array for the metamaterial-substrate antenna compared to the FR4 antenna. This can be explained by the unidirectional substrate enhancement that 'suppresses' the cross-polar fields generated in the substrate, resulting in less cross-polarization coupling. The signal correlation at the receiver is an important factor that affects the operation of a MIMO system. Mutual coupling between the antenna elements as well as the radio propagation environment contribute to signal correlation. Signal correlation is quantified herein using two metrics: mutual coupling between the antenna elements and the correlation coefficient.

Higher mutual coupling between the antenna elements in a MIMO system leads to higher correlation between the received signals and thus lower system performance. For arrays on both substrates considered herein, the mutual coupling between array elements was analyzed in terms of the isolation ($S_{21}$) between them. Isolation between the antenna elements was measured using a vector network analyzer in free space with the antennas mounted on the testbed as shown in FIG. 3.

Figure 8:
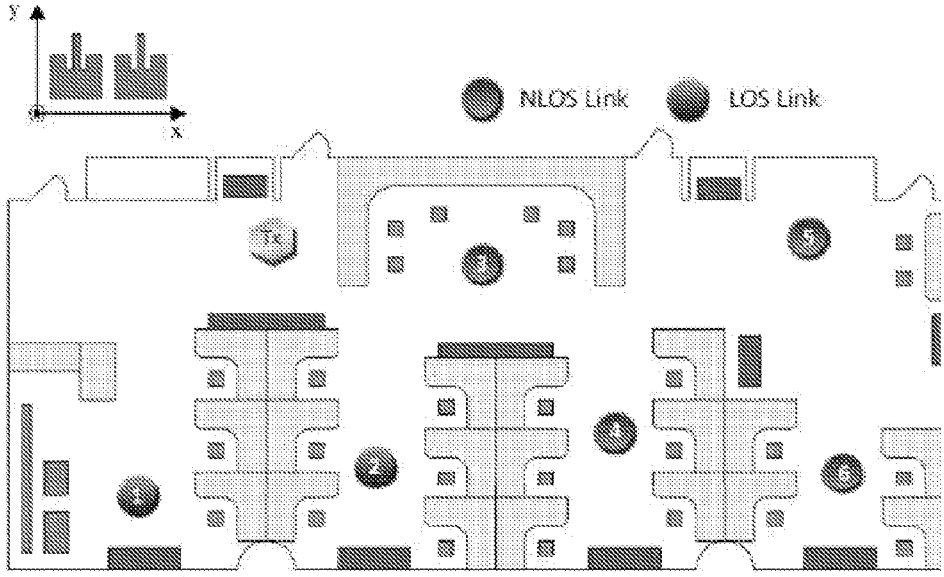
FIG. 8 illustrates a 2D CAD model of indoor test environment showing the transmitter and receiver locations and the antenna array orientation.

The measured isolations for the metamaterial-substrate antenna array and the conventional FR4 antenna array are shown in FIG. 8. The result shows a difference of 15 dB in isolation between the metamaterial and FR4 antenna arrays at very low inter element spacing. This difference drops to around 10 dB for higher spacing. This trend implies that the received signals will be significantly less correlated for the metamaterial-substrate antenna compared to the FR4 antenna for a given spacing. Another interesting observation is that the isolation does not vary as much with inter-element spacing for the metamaterial-substrate antenna; the difference in isolation between $\lambda/20$ and $7\lambda/10$ is 10 dB whereas the isolation varies by 16 dB for the FR4 antennas.

Correlation coefficient between the receiving antenna elements in a given environment takes into account both the antenna's radiation pattern as well as the power angular spectrum (PAS) of the environment and is thus an effective parameter to characterize the degree of signal degradation due to antenna and environmental correlation effects. The correlation coefficient between the antenna elements in a MIMO array is given by:

$$\rho_e = \frac{2\{XPRE_{\theta 1}(\theta,\varphi)E^*_{\theta 2}(\theta,\varphi)P_\theta(\theta,\varphi) + E_{\varphi 1}(\theta,\varphi) E^*_{\varphi 2}(\theta,\varphi)P_\varphi(\theta,\varphi)\}\exp^{-j\beta x} d\varphi d\theta^2}{2\{XPRE_{\theta 1}(\theta,\varphi)E^*_{\theta 1}(\theta,\varphi)P_\theta(\theta,\varphi) + E_{\varphi 1}(\theta,\varphi)E^*_{\varphi 1}(\theta,\varphi)P_\varphi(\theta,\varphi)\}d\varphi d\theta \times \{XPRE_{\theta 2}(\theta,\varphi)E^*_{\theta 2}(\theta,\varphi)P_\theta(\theta,\varphi) + E_{\varphi 2}(\theta,\varphi)E^*_{\varphi 2}(\theta,\varphi)P_\varphi(\theta,\varphi)\}d\varphi d\theta}$$

where X P R is the cross polarization power ratio, P (θ, ϕ) and P (θ, ϕ) are the θ and ϕ components of the PAS of the incident waves and $E_{\theta k}$ (θ, ϕ), $E_{\phi k}$ (θ, ϕ) are the θ and ϕ components of the $k^{th}$ antenna's complex electric field envelopes, x is the distance between the two antenna elements and β is the wave number.

The propagation environment is specified by the PAS of the vertically and horizontally polarized incident radio waves. The power angular spectrum of the vertically and horizontally polarized received signals are assumed to be distributed uniformly in azimuth and distributed as a Gaussian function in elevation which is consistent with the measured results reported in for an indoor environment. Therefore, the distributions corresponding to PAS are given by:

$$P_\theta(\theta,\varphi) = A_\theta \exp r - \frac{(\theta-\theta_v)^2}{2\sigma_v^2} 1, \theta \in h - \frac{\pi}{2}, \frac{\pi}{2} i$$

$$P_\varphi(\theta,\varphi) = A_\varphi \exp r - \frac{(\theta-\theta_h)^2}{2\sigma_h^2} 1, \theta \in h - \frac{\pi}{2}, \frac{\pi}{2} i$$

where $A_\theta$ and $A_\phi$ are constants that satisfy the condition that the area under both the curves sum to 1, $\theta_V$ and $\theta_h$ are the means and $\sigma_v$ and $\sigma_h$ are the standard deviations of the θ and ϕ polarized components, respectively. The correlation coefficients for the two antenna array under different element spacings in an environment are characterized by the following parameters: $m_V = m_V = 3°$, $\sigma_V = \sigma_H = 10°$ and XPR=7 dB. The choice of these values was based on the measurement results reported for an indoor picocell by K. Kalliola et al. in "Angular Power Distribution and Mean Effective Gain of Mobile Antenna in Different Propagation Environments," IEEE Transactions on Vehicular Technology, Vol. 51, No. 5, pp. 823-838, September 2002. The closely spaced FR4 antennas experience higher correlation than the metamaterial-substrate antennas. The FR4 antenna is heavily correlated at closer spacings and correlation improvement is significant with increased spacing, whereas the metamaterial-substrate antenna is reasonably uncorrelated even at closer inter-element spacings.

Thus, as a result of the high inter-element isolation between the elements, the metamaterial antenna array remains significantly less correlated at closer inter-element spacings in a typical indoor propagation environment.

Though antenna gain is a good measure for an antenna's performance in a stationary wireless communication system, it does not give complete information to the system designer on how well the antenna will perform in a mobile system due to the randomness of the multipaths. The mean effective gain (MEG) of an antenna has been used as a possible measure to evaluate an antenna's performance in such mobile wireless channels. MEG of an antenna is evaluated by considering the mean received signal power by the test antenna and a reference antenna while they traverse a random route that is representative of the environment for which the MEG is considered to be valid. MEG is significantly affected by the antenna's gain pattern and the radio propagation environment. Thus, the MEG of the metamaterial substrate array will be analytically evaluated and compared with the FR4 substrate array for different propagation scenarios.

The following analytical expression for MEG is used in our analysis:

$$MEG = \int_0^{Z_{2\pi}} \int_0^{Z_\pi x} \frac{XPR}{1+XPR} G_\theta(\theta,\varphi)P_\theta(\theta,\varphi) + \frac{1}{1+XPR} G_\varphi(\theta,\varphi)P_\varphi(\theta,\varphi) 1 \sin\theta d\theta d\varphi$$

FIG. 7 shows the MEG of the metamaterial-substrate antenna referenced to the FR4 antenna's MEG. The same values for $m_H$, $m_V$, $\sigma_V$ and $\sigma_H$ were assumed as above. As one would expect due to the significant gain differences between the antennas, the metamaterial substrate antenna does not outperform the FR4 antenna in any XPR region.

However, some interesting observations can be made from FIG. 7. The MEG of the λ/20 spaced metamaterial substrate antenna with respect to the λ/20 spaced FR4 antenna is close to −2 dB. This difference is less than the measured peak gain differences seen in FIG. 5. In other words, the difference in gain becomes narrower when the antennas are operated in a mobile scenario similar to the one considered for the MEG calculations. Secondly, the MEG for the λ/2 spaced metamaterial-substrate antenna with respect to its FR4 counterpart decreases to −3 dB However, this difference in MEG is still less than the measured peak gain differences.

Another observation is that there is an improvement in MEG as the cross over to positive XPR region occurs for both spacings. This MEG improvement can be explained by the higher XPD values for the metamaterial-substrate antenna shown in Table I. In the positive XPR region, most of the incident power is vertically polarized and proportionally the metamaterial-substrate antenna can better capture this power than the FR4 antenna resulting in an increase in MEG.

Measurements were taken with two nodes of the HYDRA testbed. The HYDRA testbed is a 2×2 MIMO orthogonal frequency division multiplexing (OFDM) communication system equipped with frequency agile transceivers operating in the ISM and UNII radio bands and a baseband process computer. The baseband chassis performs the analog to digital and digital to analog conversions required by the two transceivers. The system employs 64 sub-carriers in a 20 MHz bandwidth centered around 2.484 GHz out of which 52 sub-carriers are used for data transmission. The rest of the sub carriers are used for training. FIG. 8 illustrates a 2D CAD model of an indoor test environment showing the transmitter and receiver locations and the antenna array orientation.

The communication channel is assumed to be a flat fading MIMO communication channel, described by the following equation:

$$y = Hx + n \tag{1}$$

where x is the $N_t \times 1$ transmitted signal vector, y is the $N_R \times 1$ received signal vector and H is the $N_R \times N_t$ channel transfer matrix. $N_R$ and $N_t$ are the number of receivers and transmitters, respectively. n denotes additive white Gaussian noise.

Measurements were performed for 6 different array configurations: metamaterial antenna array with inter-element spacing of λ/20, λ/10 and λ/2 and the same spacing repeated with the FR4 antenna array. The H matrices obtained for each link were normalized with respect to the corresponding λ/2 spaced FR4 antenna array configuration in order to remove the difference in path losses among the different array configurations. This Frobenius normalization factor is defined as:

$$N_F = \sqrt{\frac{\|H_{(0,5\lambda),(FR4)}\|^2}{N_R N_T}} \tag{2}$$

The matrix channels for each of the 52 OFDM sub carriers were considered to be independent narrow band channel realizations. The channel capacity for each array configuration for a given sub carrier was computed using the normalized matrices as follows:

$$C = \frac{1}{N_{ch}} \sum_{i=1}^{N_{ch}} \log_2\left[\det\left(I_{N_R} + \frac{SNR}{N_T} H_i H_i^{\dagger}\right)\right] \tag{3}$$

where $IN_R$ is the $N_R \times N_R$ identity matrix and SNR is the signal to noise ratio. $N_{ch}$=200 is the number of channel realizations measured at each receiver position for every sub carrier. Hi is the normalized channel matrix corresponding to the $i^{th}$ channel realization. $H_i^{\dagger}$ denotes the complex conjugate transpose operation as described by H. Blcskei, D. Gesbert, and A. J. Paulraj in "On the Capacity of OFDM-Based Spatial Multiplexing Systems," IEEE Transactions on Communications, Vol. 50, No. 2, pp. 225-234, February 2003.

Figure 9:
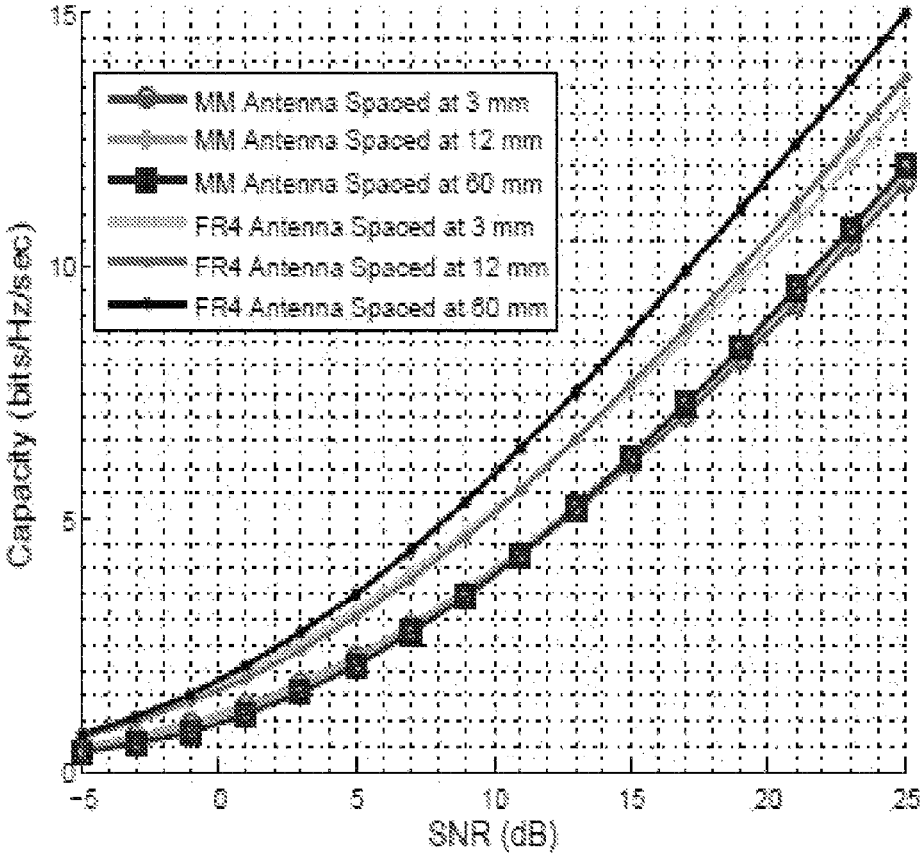
FIG. 9 illustrates average channel capacity as a function of SNR for the metamaterial and FR4 antenna arrays for different inter-element spacing.

The average capacities achieved as a function of signal to noise ratio over multiple channel realizations and different links for the 6 different array configurations for a single subcarrier are shown in FIG. 9. Due to their much higher gain, the FR4 substrate antennas outperform the metamaterial substrate antenna. However, it is worth noticing that the performance of the metamaterial antenna is relatively unchanged with different inter-element spacing. The λ/2 spaced metamaterial antenna array shows only a 0.4 bits/Hz/sec maximum improvement over its λ/20 spaced array whereas the λ/2 spaced FR4 array shows a 2 bits/Hz/sec improvement. This unchanging capacity can be explained by looking at FIG. 7 where mutual coupling varies comparatively little with increasing interelement spacing for the metamaterial array.

For a given throughput requirement, this result makes the metamaterial antenna a highly suitable candidate for a MIMO system because it can be spaced very closely together without sacrificing performance. This close spacing reinforces the already small structure of the metamaterial substrate antenna, leading to a significant reduction in antenna footprint in the system.

For a more fair comparison of the two antenna substrates, a cumulative distribution function (cdf) was assembled using the capacities computed for the multiple channel realizations over different sub-carriers and links for the 6 different array configurations. The channel matrices used to compute these capacities were normalized independently with respect to each antenna array configuration in order to remove the efficiency and gain mismatch effects between array configurations. This Frobenius normalization factor in this case is defined as:

$$N_{F,Configuration} = \sqrt{\frac{\|H_{Configuration}\|^2}{N_R N_T}} \tag{4}$$

Figure 10:
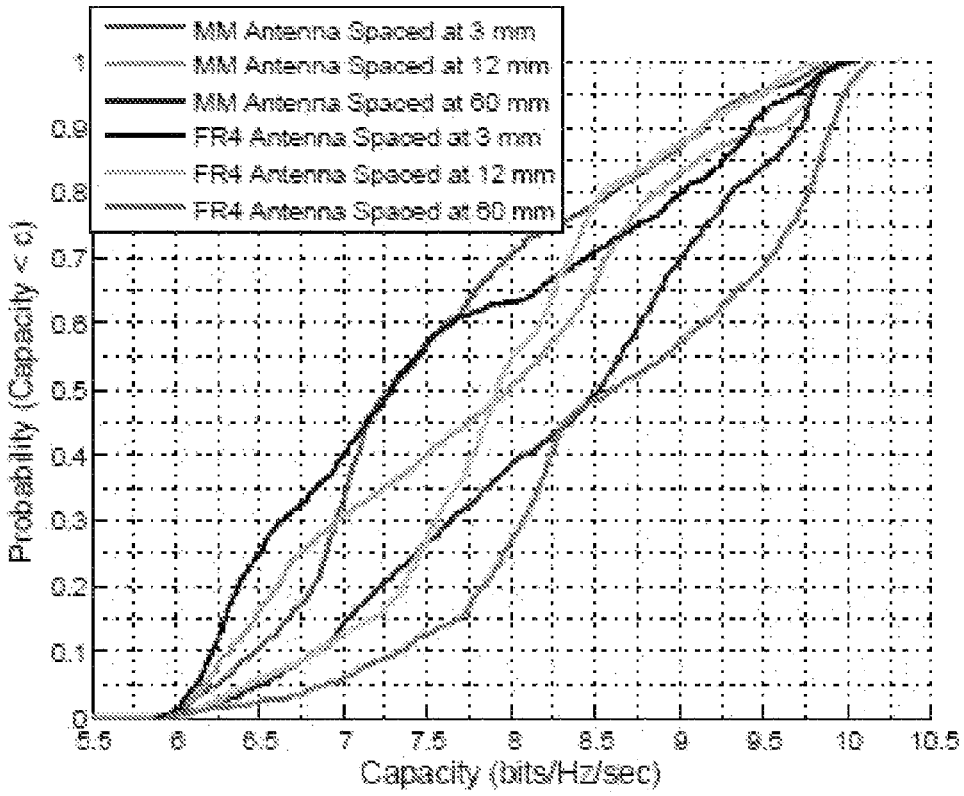
FIG. 10 illustrates the CDF of channel capacity for the metamaterial and FR4 antenna arrays for different inter-element spacing after normalizing for efficiency and gain mismatch effects.

The cdf results are shown in FIG. 10 for a SNR of 10 dB. For a given inter-element spacing, it can be seen that the two arrays show similar performance. For any given outage probability, the metamaterial antenna array either outperforms the FR4 array or lies within a 1 bit/Hz/sec difference.

Figure 11:
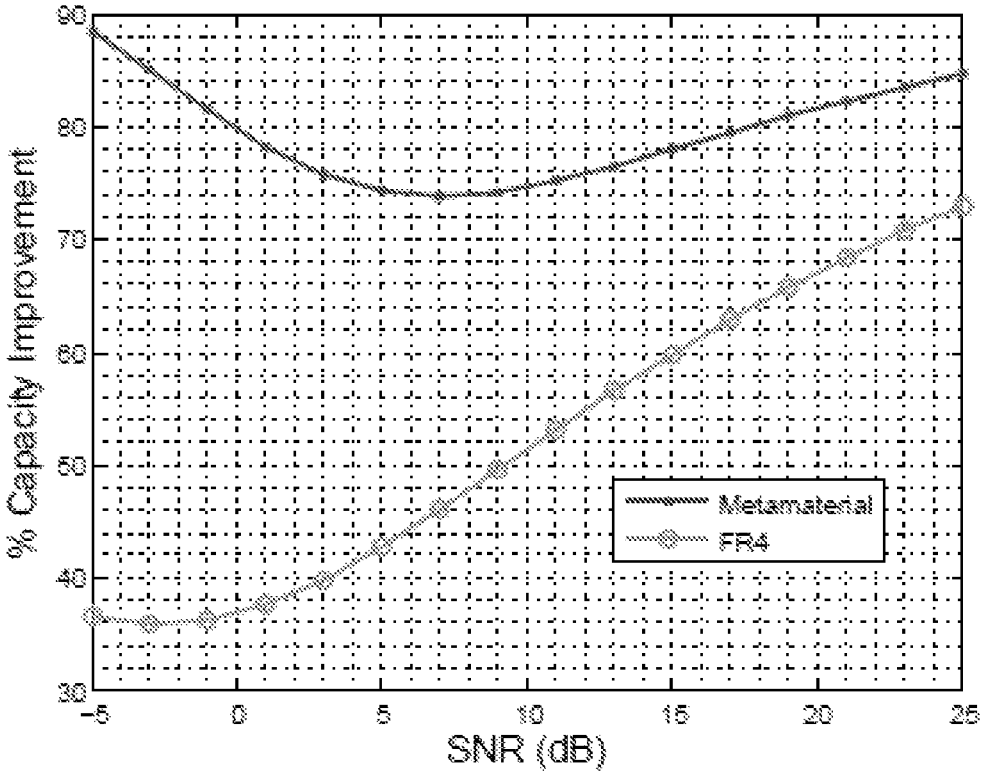
FIG. 11 illustrates percentage capacity improvement of MIMO system over SISO system with SNR for metamaterial and FR4 antenna arrays with 12 mm ($\lambda/2$) inter-element spacing.

Theoretically, MIMO system capacity increases linearly with min(NT, NR). In practice, this increase in throughput is affected by mutual coupling. In order to see which antenna array comes closer to achieving theoretical MIMO performance improvements, the channel capacities achieved by both the arrays were compared to the capacities achieved by their single input single output (SISO) link counterparts. Channel measurements were taken using single antenna elements at both ends of the link for the same measurement topology described earlier. FIG. 11 shows that the metamaterial antenna array shows better throughput improvement relative to SISO than the FR4 array. This trend can be explained by noting that mutual coupling is less prevalent in a metamaterial antenna array substrate. FIG. 11 shows the MIMO system that employed the metamaterial antenna array achieved high levels of throughput improvement peaking at nearly 89% at −5 dB. The FR4 antenna array, by comparison, achieved a performance increase of 38% at this SNR. At high SNR levels, both antenna arrays showed large capacity improvements with the metamaterial array slightly outperforming the FR4 array.

Thus, the invention includes a method of improving the capacity and mutual coupling performance of a MIMO antenna array by selecting $N_T$ transmitter antennas and $N_R$ receiver antennas each comprising a metamaterial substrate so as to form a resonance structure based on induced inductance of the metamaterial substrates combined with the capacitance of the metamaterial substrates. A statistical description of a transmission environment including the MIMO antenna array is determined, where the statistical description is provided in a matrix $H_i$ where $H_i$ is the normalized channel matrix corresponding to an $i^{th}$ channel realization where $H_i$ includes interference and signal to noise as a product of the location and spacing of the NT transmitter antennas and NR receiver antennas. The normalized channel matrix is used to compute the channel capacity C for each array configuration for a given subcarrier and the $N_T$ transmitter antennas and $N_R$ receiver antennas are mounted on the metamaterial substrates in an array configuration so that the resulting antenna array has channel capacities C that are approximately the same as channel capacities C of relatively larger antenna arrays formed without the metamaterial substrates. As noted above, the channel capacity C of each channel i is computed as:

$$C = \frac{1}{N_{ch}} \sum_{i=1}^{N_{ch}} \log_2\left[\det\left(I_{N_R} + \frac{SNR}{N_T} H_i H_i^{\dagger}\right)\right],$$

where $N_{ch}$ is a number of channel realizations measured at each receiver antenna position for every subcarrier, $I_{NR}$ is a $N_R \times N_R$ identity matrix, SNR is signal to noise ratio in channel i, and $H_i^{\dagger}$ is a complex conjugate transpose operation.

Due to their correlation characteristics, the antennas are conducive for MIMO transmission schemes based on spatial multiplexing, space-time coding, MIMO OFDM, MIMO spread spectrum etc. A plethora of previous work has shown that significant capacity gains can result from the use of such transmission schemes. However, in most channel scenarios, such gains can be made only when the wireless channel between different pairs of transmit-receive antennas are independent and identically distributed (i.i.d.). However, in practice the signals received by different antennas will be correlated which will reduce the performance of these transmission schemes. Since the amount of correlation between the different received signals is significantly influenced by the mutual coupling as well as the antenna radiation patterns (which manifests as a lower correlation coefficient), antennas built on the metamaterial substrate are much suited to exploit the gains provided by such transmission schemes in a MIMO communication system.

The metamaterial antenna structure in accordance with the invention may be used to design a variety of array-based wireless communication devices with compact antenna array element spacings including, for example, a wireless local area network (LAN) or a personal wireless communications device such as mobile phone or a wireless email device.

In summary, the metamaterial antenna structure in accordance with the invention provides numerous advantages. For example, antenna arrays built on the metamaterial substrate have good cross polar discrimination (XPD) characteristics that help reduce mutual (cross polar) coupling between closely spaced adjacent antennas in the array. This is a very critical factor to the performance of MIMO communications. Also, the mutual coupling between array elements has been found to be significantly less for antenna arrays built on the metamaterial substrate compared to conventional substrates. Signals received at different elements of the antenna array built on the metamaterial substrate also show considerably high de-correlation in typical indoor environments. These factors combined together form a compelling argument for the use of antenna arrays built on the metamaterial substrate for MIMO communications. Also, the combination of the above two observations results in a higher 'mean effective gain'—a practical measure for the performance of an antenna in an actual communication system, for the antenna system in a MIMO array, than a similar array built on a conventional substrate.

Those skilled in the art also will readily appreciate that many additional modifications are possible in the exemplary embodiment without materially departing from the novel teachings and advantages of the invention. Accordingly, any such modifications are intended to be included within the scope of this invention as defined by the following exemplary claims.

What is claimed:

1. A method of improving the capacity and mutual coupling performance of a MIMO antenna array, comprising:

selecting $N_T$ transmitter antennas and NR receiver antennas each comprising a metamaterial substrate so as to form a resonance structure based on induced inductance of the metamaterial substrates combined with the capacitance of the metamaterial substrates;

determining a statistical description of a transmission environment including said MIMO antenna array, where the statistical description is provided in a matrix $H_i$, where Hi is the normalized channel matrix corresponding to an $i^{th}$ channel realization where $H_i$ includes interference and signal to noise as a product of the location and spacing of the $N_T$ transmitter antennas and $N_R$ receiver antennas;

using the normalized channel matrix to compute the channel capacity C for each array configuration for a given subcarrier; and placing said $N_T$ transmitter antennas and said $N_R$ receiver antennas, mounted on said metamaterial substrates, in an array configuration so that the resulting antenna array has channel capacities C that are approximately the same as channel capacities C of relatively larger antenna arrays formed without said metamaterial substrates.

2. The method of claim 1, wherein computing the channel capacity C of each channel i is computed as:

$$C = \frac{1}{N_{ch}} \sum_{i=1}^{N_{ch}} \log_2\left[\det\left(I_{N_R} + \frac{SNR}{N_T} H_i H_i^{\dagger}\right)\right],$$

where $N_{ch}$ is a number of channel realizations measured at each receiver antenna position for every subcarrier, $I_{NR}$ is a $N_R \times N_R$ identity matrix, SNR is signal to noise ratio in channel i, and $H_i^{\dagger}$ is a complex conjugate transpose operation.

* * * * *